US006640852B1

(12) United States Patent
Rogers

(10) Patent No.: US 6,640,852 B1
(45) Date of Patent: Nov. 4, 2003

(54) FOUR-WAY LOG SPLITTER AND HANDLER

(76) Inventor: Dennis Rogers, 182 S. Paul Rd., St. Mary's, PA (US) 15857-3428

( * ) Notice: Subject to any disclaimer, the term of this patent is extended or adjusted under 35 U.S.C. 154(b) by 0 days.

(21) Appl. No.: 10/228,021

(22) Filed: Aug. 26, 2002

(51) Int. Cl.[7] ..... B27L 7/00

(52) U.S. Cl. ..... 144/195.1; 144/3 K; 144/366; 269/303

(58) Field of Search ..... 144/193.1, 195.1, 144/195.8, 366, 4.6; 269/217, 237, 238, 239, 289 R, 303, 315

(56) References Cited

U.S. PATENT DOCUMENTS 4,176,696 A 12/1979 Greeninger
4,337,809 A * 7/1982 Bertolette et al. ..... 144/195.1
4,391,312 A * 7/1983 Sakraida, Jr. ..... 144/195.8
4,483,379 A 11/1984 Aikins et al.
4,615,366 A 10/1986 Scarbrough, Jr.
4,782,866 A * 11/1988 Valdez ..... 144/199.1
4,800,937 A * 1/1989 Mangus, Sr. ..... 144/199.8
4,860,806 A * 8/1989 Brace ..... 144/195.8
4,881,584 A 11/1989 Wislocker et al.
4,951,726 A 8/1990 Sieverin
4,961,452 A 10/1990 Hudson
5,894,873 A 4/1999 Weeks

* cited by examiner

*Primary Examiner*—W. Donald Bray
(74) *Attorney, Agent, or Firm*—Lawrence E. Laubscher, Jr.

(57) ABSTRACT

A device for handling and splitting logs is characterized by a unique mechanism for holding logs while they are cut into sections of a desired length and then simultaneously splitting the cut sections into quarters. The log holding apparatus is arranged on a portable frame and inclined bed for the logs, the entire apparatus being easily transported to the log handling site.

12 Claims, 4 Drawing Sheets

FIG. 3
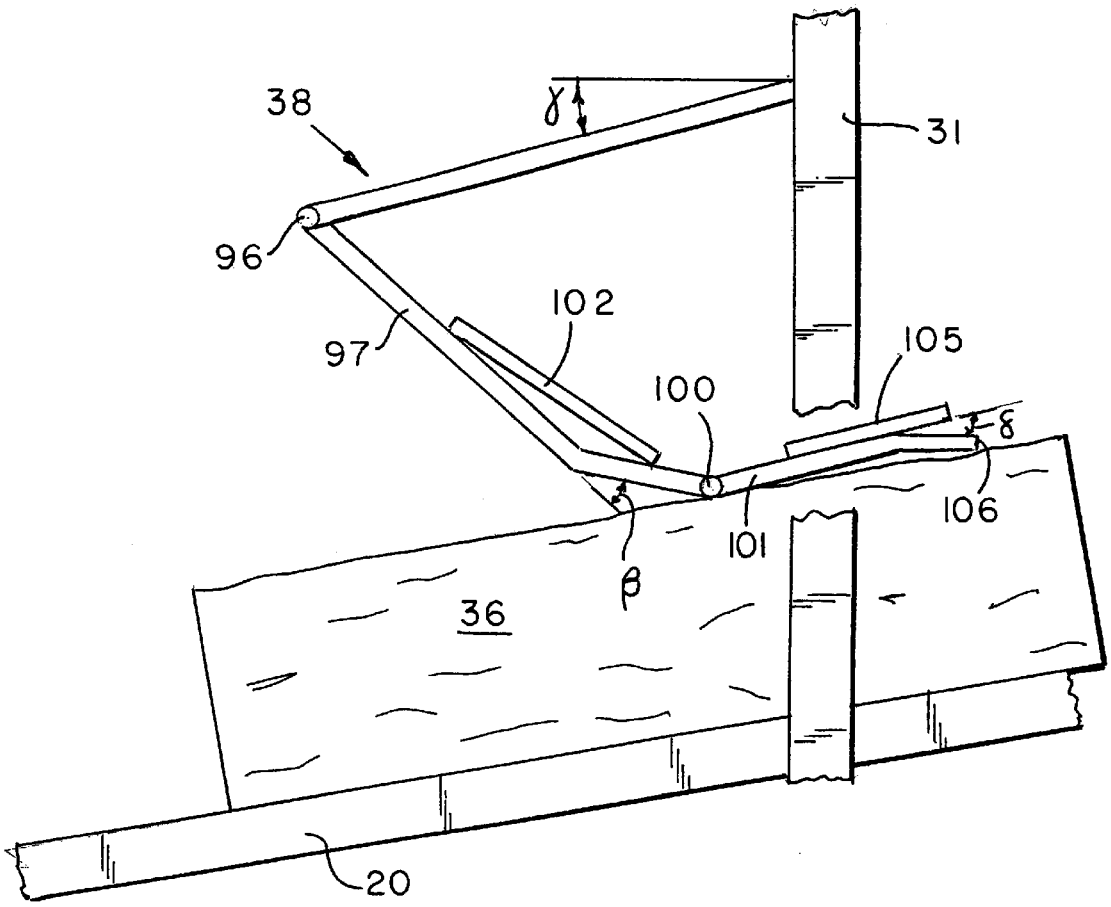
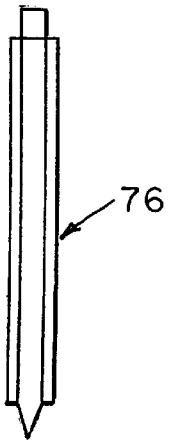
FIG. 6

FOUR-WAY LOG SPLITTER AND HANDLER

BACKGROUND OF THE INVENTION

This invention relates to log splitting and handling device, and more particularly to a device for positioning a log for cutting into firewood lengths and for splitting the cut log into four pieces.

BRIEF DESCRIPTION OF THE PRIOR ART

Cutting logs into firewood is routinely a two step process, including: (1) cutting the log into firewood lengths using a saw and (2) splitting each length into two or four pieces. Devices are known for automating these steps, and the prior art also teaches the combining of these two steps in a single device. U.S. Pat. No. 5,894,873 to Weeks and U.S. Pat. No. 4,176,696 to Greeninger are representative of such devices. Greeninger also illustrates a sloping conveyer system by which a log may be pulled into cutting position without the necessity of lifting it. This reduces the physical effort required to move a log into cutting position, but it increases the need to adequately secure the log in position while cutting occurs. If the log is inadequately supported, saw kick-back is possible or the log may slide out of position. The requirement to effectively secure the log in position may be inconsistent, however, with a need for simplicity of operation and low cost of construction. Securing mechanisms based on use of heavy weights or power-driven rollers, for example, are not entirely satisfactory.

Hydraulic devices for splitting firewood commonly have a single wedge for splitting the log in two. If a log must be split into four pieces, i.e., quartered, as many as three separate cuts may be required. When it is desired to combine the cutting and splitting operations into one process, however, the log-splitting operation must be synchronized with the log-cutting operation for maximum efficiency. In a particular, it is desirable that splitting be a one-step process requiring substantially the same amount of time to split one log as it takes to cut one length. In an effort to solve this problem, combination wedges having two cutting edges have been developed. U. S. Pat. No. 4,951,726 to Sieverin illustrates a cutting wedge for splitting a log into four pieces in a single motion of the hydraulic cylinder. The more complex wedge structure is not without its disadvantages, however, for significantly more pressure is required to split a log into four pieces than to split it into two pieces. The design of the wedge greatly affects how efficiently it operates.

SUMMARY OF THE INVENTION

The log cutting and splitting device according to the present invention includes an improved structure for securing and stabilizing a log during cutting and also for splitting a cut log into firewood. The device is easily portable to a work site, yet is rugged and easily operated by two operators. A first operator moves a log to be cut into position with a power operated winch. The positioned log is firmly and securely held in place for cutting by a unique log-holding device. After a cut, the winch moves the uncut log forward, thereby pushing the cut log onto an angled discharge tray. The log is conveyed by gravity to an adjacent log splitter controlled by a second operator. A uniquely shaped wedge quarters the log with a single motion of the hydraulic cylinder and the second operator is ready to receive the next cut length of the log.

Accordingly, it is an object of the invention to provide a passive device for holding logs securely in position for cutting.

It is another object to provide an improved wedge for quartering logs.

It is still another object to efficiently cut and split firewood in a continuous two-person operation Finally, it is an object to provide an easily manufactured wood cutting and splitting device that is efficient and simple to operate.

A log holding device according to the present invention includes: (a) an inclined bed having a first end and a second end, the first end being substantially at ground level; (b) a frame for supporting the second end of the bed above ground level, the frame extending above the bed; (c) apparatus for holding the log in position to be cut on the bed, comprising: (i) a first member rigidly affixed to the frame above the bed at a sufficient distance to permit logs to pass thereunder; (ii) a second member pivotally affixed to, and extending downward from, the first member, the second member resting upon a log in cutting position and inclined toward the end of the log to be cut; and (iii) a third member having a first end pivotally affixed to the second member, and a second end, both the first and second ends being supported by a log in cutting position, the second end extending toward the end of the log to be cut, the member being bent away from the log between the first and second ends.

A log splitting wedge according to the present invention includes: (a) a first wedge having a cutting edge extending along a first plane and an opposing edge elevated from the cutting edge relative to the first plane; (b) a second wedge extending along a second plane, the second plane being substantially perpendicular to the first plane; and (c) means for forcing the log against the wedge.

An apparatus for cutting and splitting a log according to the present invention includes: (a) an inclined bed having a first end and a second end, the first end being substantially at ground level; (b) a frame for supporting the second end of the bed above ground level, the frame extending above the bed; (c) apparatus for holding the log in position to be cut on the bed, comprising: (i) a first member rigidly affixed to the frame above the bed at a sufficient distance to permit logs to pass thereunder; (ii) a second member pivotally affixed to, and extending downward from, the first member, the second member resting upon a log in cutting position and inclined toward the end of the log to be cut; (iii) a third member having a first end pivotally affixed to the second member, and a second end, both the first and second ends being supported by a log in cutting position, the second end extending toward the end of the log to be cut, the member being bent away from the log between the first and second ends; (d) a discharge conveyor for catching and carrying the cut log; (e) a platform for receiving the cut log and supporting it in position for splitting; (f) a log splitter, including (i) a first wedge having a cutting edge extending along a first plane and an opposing edge elevated from the cutting edge; (ii) a second wedge extending along a second plane, the second plane being substantially perpendicular to the first plane; and a displacement device for forcing the log against the wedge.

BRIEF DESCRIPTION OF THE DRAWINGS

Other objects and advantages of the invention will become apparent from a study of the following specification when viewed in light of the accompanying drawings, in which:

FIG. 3 illustrates a long holder in accordance with the teaching of the invention;

FIG. 6 is a top plan view of the vertical blade member of the wedge of FIG. 4.

DETAILED DESCRIPTION OF THE INVENTION

Figure 1:
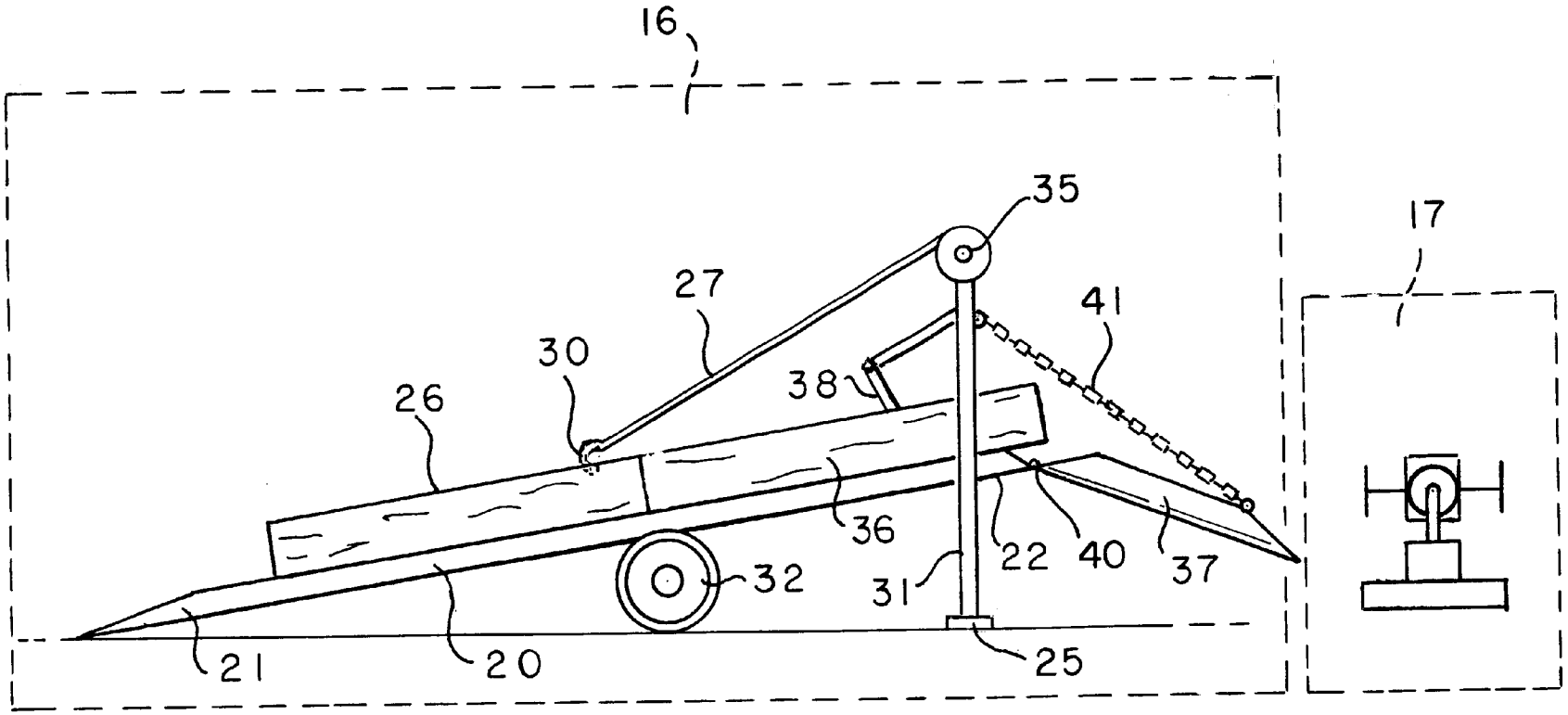
FIG. 1 illustrates a side view of a combination log cutter and splitter configured for operation in accordance with the teaching of the invention.

In the description that follows, like numbers refer to like elements throughout all figures. Referring to FIG. 1, a combination log handler 16 and log splitter 17 in accordance with the invention are illustrated as configured for operation. Log handler 16 includes an inclined log-supporting bed 20 having a first end 21 supported by the ground and a second end 22 supported off the ground by removable jacks 25 on a frame 31. Wheels 32 are provided for transportation of the device. When the log cutter/handler combination is configured for operation as in FIG. 1, the wheels may remain touching the ground to provide some support for bed 20. However, jacks 22 and frame 31 provide the principal support for bed 20 to ensure stability and minimize movement of the apparatus as logs are moved up the bed. Frame 31 is rigidly connected to bed 20 such that frame 31 is substantially vertical with respect to the ground when the log cutter is in operating position, i.e., when wheels 32 have been supported by jacks 25 and the lower end 21 of bed 20 is supported on the ground.

A winch 35 is affixed atop frame 31 for drawing logs up the incline of bed 20 until a log is in position to be cut. A log to be cut and split is initially positioned near the bottom of bed 20 near lower end 21, and a cable 27 is attached. The attachment may be made by a hook 30, a chain wrapped around the log, or any other similar method. The log is moved up bed 20 until its lower end is fully on the bed, as is shown by the position of log 36. At this point, a second log is positioned near the bottom of bed 20 and hook 30 will be repositioned from the first log 36 to the second log 26. Log 36 is pushed up bed 20 by the following log 26 as winch 35 puts tension on cable 27. For reasons of both safety and efficiency, a winch operating switch is preferably positioned on frame 31 such that it can be activated by pressure applied by the first operator's front thigh. A conventional industrial "on-when-depressed" switch would permit the operator to advance the log by depressing the switch with his leg without setting a chain saw down after each cut. Once the log is in position, a log holding device 38 grips the log and secures it in position during the cut. Structural details and operation of device 38 are more fully described with respect to FIG. 3 below.

When log 36 is in position to be cut, a log section substantially equal in length to a standard fireplace log (usually 16"–18") will overhang a discharge conveyer 37. Preferably, when the log cutter is set up for operation, conveyer 37 is connected to bed 20 by a hinge 40 and, near the top of frame 31, by a chain 41. This arrangement permits conveyer 37 to be drawn up to facilitate transportation. It also provides for adjustment of the angle of conveyer 37 relative to log handler 17 to ensure proper transfer of cut logs to the log handler. After being cut, a log falls onto conveyer 37 and rolls onto a platform 45 (FIG. 2) of log handler 17.

Figure 2:
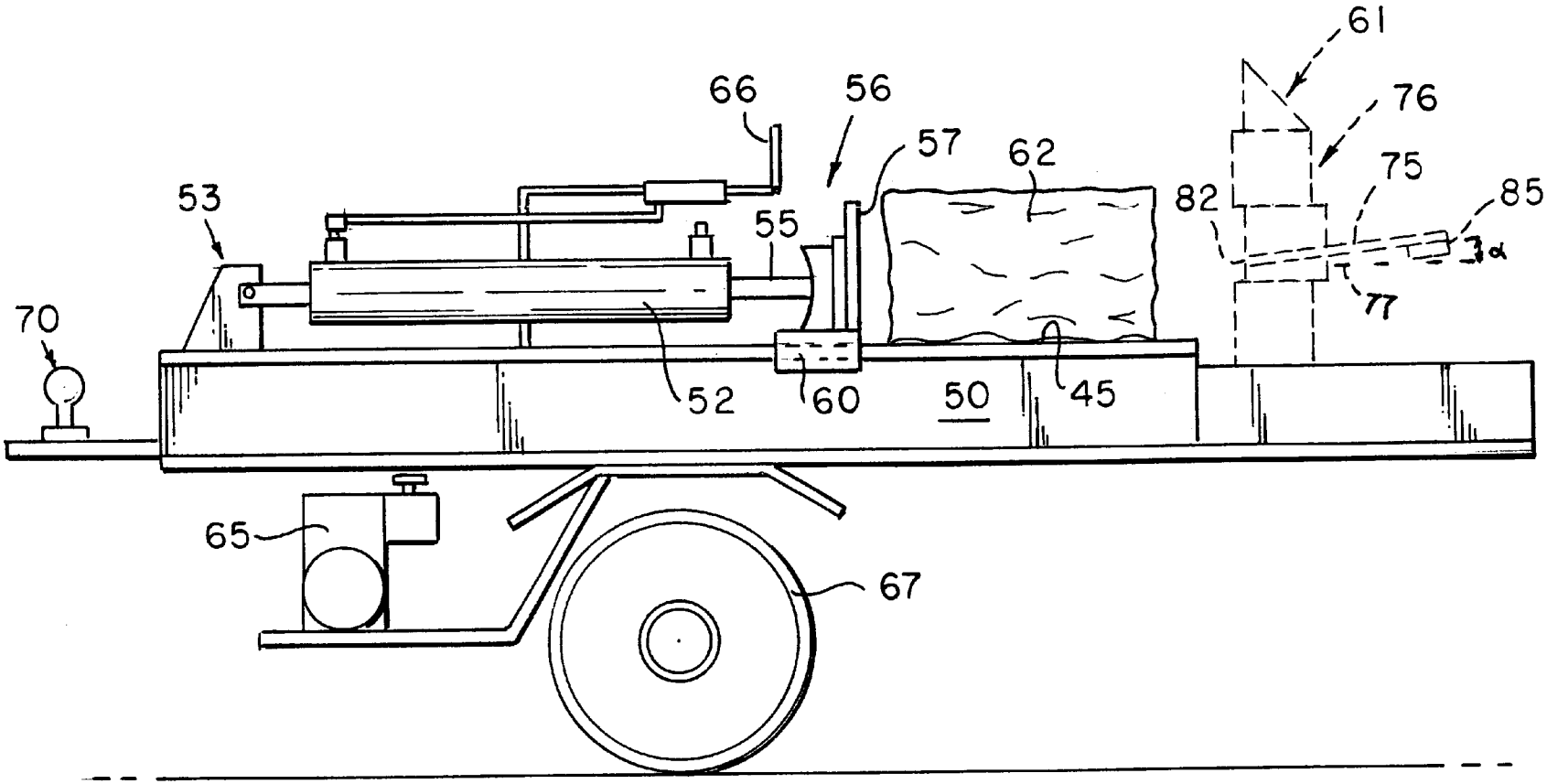
FIG. 2 illustrates a side view of a log holding device in accordance with the teaching of the invention.
Figure 4:
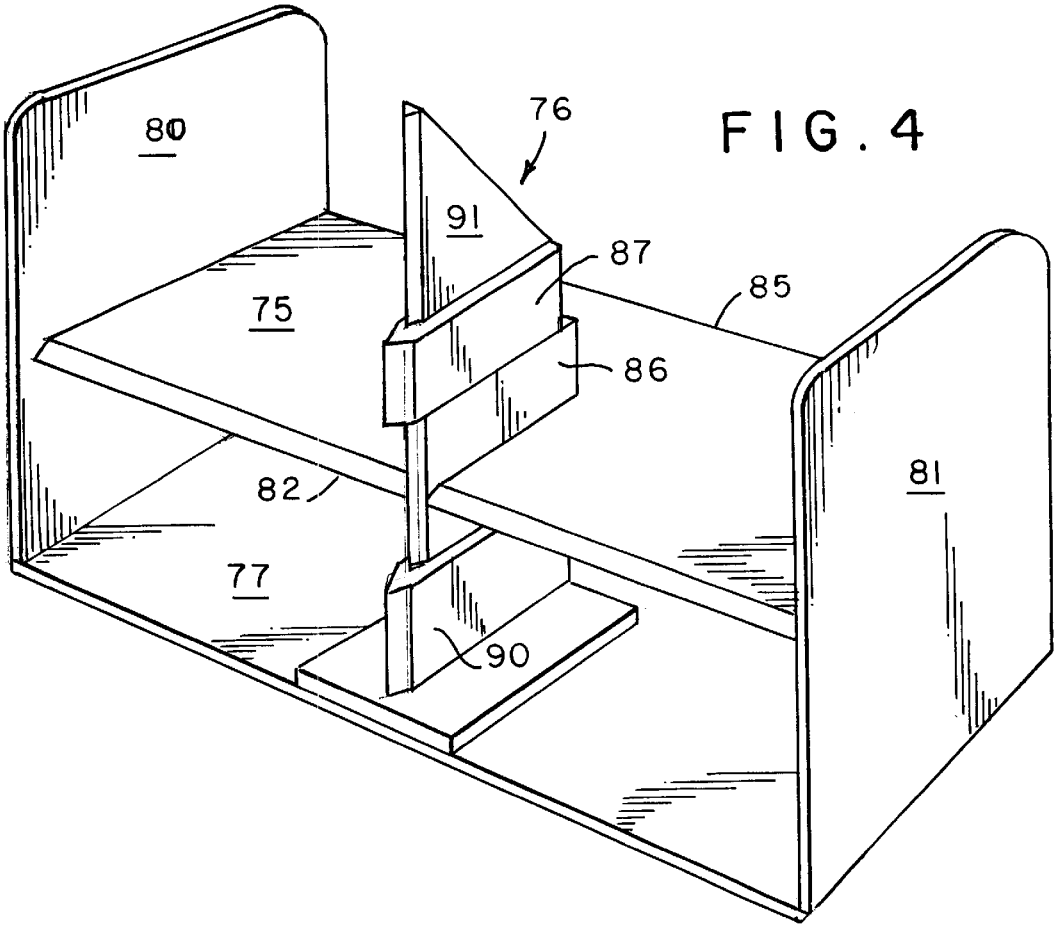
FIG. 4 is a perspective view of a log-quartering wedge in accordance with the teaching of the invention.
Figure 5:
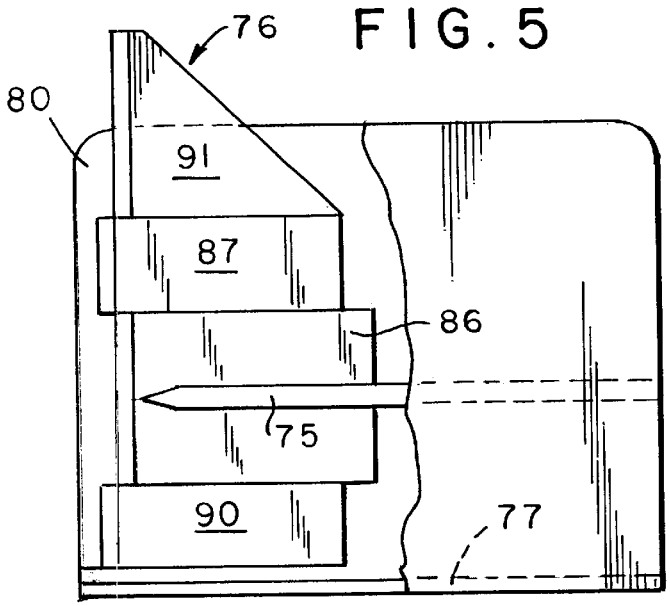
FIG. 5 is side plan view of the wedge of FIG. 4.

FIG. 2 is a side view of log handler 17. A steel I-beam 50 or similar rigid structure supports a pneumatic cylinder 52. A bracket assembly 53 rigidly connects one end of cylinder 52 to I-beam 50 to prevent relative motion between them. A piston rod 55 extending from cylinder 52 engages a support assembly 56 having a log-engaging pad 57 on a slidable member 60. A four-way wedge splitting blade assembly 61, described in more detail below with respect to FIG. 4, is rigidly attached to I-beam 50. That part of I-beam 50 between pad 57 and assembly 61 serves as a platform 45 onto which a cut log is carried by conveyer 37. A power source 65, such as a gasoline engine, powers cylinder 52, which is manually operated via a lever 66 by the second operator. Once a log is in position, the second operator uses lever 66 to activate the hydraulic cylinder, forcing the log against the wedge and thereby splitting it.

Log handler 17 may be mounted directly on an extension of discharge conveyer 37. Preferably, however, it will be detached and separately transportable. Wheels 67 and a hitch structure 70 mounted to I-beam 50 facilitate transportability.

FIG. 3 illustrates a log holding device 38 in accordance with the present invention. A rigid arm 95 is securely and immovably attached to frame 31 above bed 20. A hinge 96 connects arm 95 to an arm 97 to permit arm 97 to pivot freely relative to arm 95. Another hinge 100 similarly connects another arm 101 to arm 97 to permit pivoting motion between them. Arms 95, 97 and 101 may be steel plates, the size of which will be determined primarily by the structural strength requirements necessitated by the size of logs being cut. Additional structural support and weight may be provided by plates 102 and 105 welded to arms 97 and 101, respectively.

With no log on bed 20, arms 97 and 101 will hang freely, with plate 101 resting on bed 20. As a log 36 is moved up bed 20, its leading edge 106 will push against arms 97 and 101 and pivot them to a position as shown in FIG. 3. Forward movement of log 36 will be unimpeded by the arms. Once log 36 is in position for cutting, however, the log holding device 38 will hold the log securely in place and prevent movement of the log backward down the incline of bed 20. Note in particular that arm 97 is bent at an angle $\beta$ away from the log and arm 101 is bent at an angle $\delta$ toward the log. These bends cause the lower leading edge 106 of arm 105 to be forced downward by any attempted backward motion of log 36, thereby gripping the log and holding it in place. The amount of the gripping force will increase with increasing backward force exerted by log 36. As a result, the log is held firmly in place during the cutting operation, yet the holding device requires no attention and provides no obstacle to movement of the log during its forward movement into cutting position.

With reference to FIGS. 2, 4, 5, and 6, a log-splitting wedge in accordance with the present invention includes a substantially horizontal blade member 75 and a substantially vertical blade member 76. A horizontal plate 77 and first and second vertical plates 80 and 81, respectively, secure blades 75 and 76 in place for rigidity and strength. As is shown in FIG. 2, horizontal blade 75 is angled slightly such that the cutting edge 82 of the blade is closer to plate 77 than is the opposite edge 85. The symbol a denotes the angle of deviation from the parallel between blade 75 and plate 77. Angle a will preferably be quite small, on the order of 1°. However, this small angle significantly improves the cutting efficiency of the quartering wedge and reduces the potential for the apparatus to bind. The cutting edge 82 of blade 75 is positioned within supporting plates 77, 80 and 81 such that it will engage the log at substantially the log's center.

The segmented structure of vertical blade 76 promotes efficient splitting and further inhibits binding of the log. A center cutting blade section 86 is positioned above and below horizontal blade 75 to engage the log at substantially the log's center. Center blade section 86 and horizontal blade 75 are positioned to permit both blades to engage the log at the same time. Above and below center blade section 86 are blade sections 87 and 90. The cutting edges of blade sections 87 and 90 are set forward of blade section 86 such that blades 87 and 90 engage the log before blade sections 75 and 86. An additional blade section 91 may be affixed atop blade section 87 to ensure splitting of logs having a diameter too large to be fully split by blade 87. Both blade sections 87 and 90 are preferably equal in thickness, but are thicker than central blade section 86 to increase their wedging action. The thickness of blade section 91 may be somewhat less than that of blade section 86. Experimentation has determined that a thickness of about 1 inch for blade section 86, ¾ inch for blade sections 87 and 90, and ½ inch for blade section 91 works well.

While the preferred forms and embodiments of the invention have been illustrated and described, it will be apparent to those of ordinary skill in the art that various changes and modifications may be made without deviating from the inventive concepts set forth above.

What is claimed is:

1. An apparatus supporting a log to be cut, comprising a) an inclined bed having a first end and a second end, the first end being substantially at ground level;

b) a frame for supporting the second end of the bed above ground level, the frame extending above the bed;

c) means for holding the log in position to be cut on the bed, comprising:

i) a first member rigidly affixed to the frame above the bed at a sufficient distance to permit logs to pass thereunder;

ii) a second member pivotally connected with, and extending downward from, the first member, the second member resting upon a log in cutting position and inclined toward the end of the log to be cut; and iii) a third member having a first end pivotally connected with the second member, and a second end, both the first and second ends being supported by a log in cutting position, the second end extending toward the end of the log to be cut, the member being bent away from the log between the first and second ends.

2. Apparatus as defined in claim 1, wherein the first member is substantially parallel to the bed.

3. Apparatus as defined in claim 2, wherein the second member has a bend near its lower end, the bend being toward the end of the log to be cut.

4. Apparatus as defined in claim 3, wherein the second and third members have supporting brackets rigidly affixed thereto.

5. A log splitting apparatus comprising a) a first wedge having a cutting edge extending along a first plane and an opposing edge elevated from the cutting edge relative to the first plane;

b) a second wedge extending along a second plane the second plane being substantially perpendicular to the first plane, the second wedge comprising a first section having a cutting edge at the same vertical plane as the first wedge relative to the direction of log movement and second and third sections displaced from the first section and extending forward of the vertical plane of the first section relative to the direction of log movement; and c) means for forcing the log against the wedge.

6. Apparatus as defined in claim 5 wherein the first wedge and the first section of the second wedge are of substantially the same thickness.

7. Apparatus as defined in claim 5, wherein the second and third sections of the second wedge are relatively thicker than the first section.

8. Apparatus as defined in claim 5, and further comprising a) a first planar member substantially parallel to the first plane and rigidly supporting the second wedge; and b) second and third planar members extending substantially parallel to, and on opposite sides of, the second wedge, the second and third members being rigidly affixed to and supporting the ends of the first planar member and the first wedge.

9. Apparatus as defined in claim 8, wherein the second wedge further comprises a fourth section opposite the first planar member having a cutting edge at the same vertical plane as the first wedge relative to the direction of log movement.

10. Apparatus as defined in claim 9, wherein the thickness of the fourth section is less than the thickness of the first section.

11. An apparatus for cutting and splitting a log, comprising a) an inclined bed having a first end and a second end, the first end being substantially at ground level;

b) a frame for supporting the second end of the bed above ground level, the frame extending above the bed;

c) means for holding the log in position to be cut on the bed, comprising i) a first member rigidly affixed to the frame above the bed at a sufficient distance to permit logs to pass thereunder;

ii) a second member pivotally affixed to, and extending downward from, the first member, the second member resting upon a log in cutting position and inclined toward the end of the log to be cut;

iii) a third member having a first end pivotally affixed to the second member, and a second end, both the first and second ends being supported by a log in cutting position, the second end extending toward the end of the log to be cut, the member being bent away from the log between the first and second ends;

d) a discharge conveyor for catching and carrying the cut log;

e) a platform for receiving the cut log and supporting it in position for splitting; and f) means for splitting the log, comprising i) a first wedge having a cutting edge extending along a first plane and an opposing edge elevated from the cutting edge;

ii) a second wedge extending along a second plane, the second plane being substantially perpendicular to the first plane; and iii) means for forcing the log against the wedge.

12. Apparatus as defined in claim 11, and further comprising means affixed to the frame for moving a log up the bed.

* * * * *